US006192911B1

(12) United States Patent
Barnes

(10) Patent No.: US 6,192,911 B1
(45) Date of Patent: Feb. 27, 2001

(54) VENTURI INJECTOR WITH SELF-ADJUSTING PORT

(76) Inventor: Ronald L. Barnes, #74 Revere Way, Huntsville, AL (US) 35801

( * ) Notice: Subject to any disclaimer, the term of this patent is extended or adjusted under 35 U.S.C. 154(b) by 0 days.

(21) Appl. No.: 09/393,437

(22) Filed: Sep. 10, 1999

(51) Int. Cl.[7] ..... F17D 1/00

(52) U.S. Cl. ..... 137/12; 137/888; 137/891; 137/829

(58) Field of Search ..... 137/891, 892, 137/888, 12

(56) References Cited

U.S. PATENT DOCUMENTS 4,111,219 * 9/1978 Hallberg et al. ..... 137/3
4,714,092 * 12/1987 Sanders ..... 137/894
5,893,641 * 4/1999 Garcia ..... 366/163.2
5,899,641 * 5/1999 Pfeiffer ..... 406/144
5,927,338 * 7/1999 Boticki et al. ..... 137/888

* cited by examiner

*Primary Examiner*—A. Michael Chambers
*Assistant Examiner*—Thomas L. McShane
(74) *Attorney, Agent, or Firm*—Mark Clodfelter

(57) ABSTRACT

A self-adjusting venturi/mixer is disclosed. An inlet port body and outlet port body having a converging region and diverging region, respectively, are longitudinally slidably disposed with respect to each other, forming an annular injection gap that widens when the ports are moved apart and narrows when the ports are moved together. The movement is accomplished by virtue of varying fluid pressure at the inlet port, which exerts frictional pull on the outlet port, pulling the inlet port body away from the outlet port body. In other embodiments, a flexible member is positioned peripherially around the annular gap so that as the gap widens, the flexible member deforms to partially close the gap. This keeps the bubble size small where a gas is being injected into a liquid, and also limits a maximum flow of additive material at excessive flow rates.

16 Claims, 5 Drawing Sheets

VENTURI INJECTOR WITH SELF-ADJUSTING PORT

FIELD OF THE INVENTION

This invention relates to adjustable venturi devices, and particularly to a fluid venturi used to mix purifying gasses or liquid or both in a motive fluid (water) and wherein the venturi is provided with an injection port that varies in size with motive fluid pressure, allowing the venturi to operate at a wider dynamic pressure range than heretofore possible.

BACKGROUND OF THE INVENTION

With respect to water purification systems of the type that utilize a venturi device in order to effect mass transfer of gasses or liquids into a stream of water, it is well known that such venturi devices will operate well only within a predefined pressure differential of the motive fluid stream. For instance, where ozone is developed by an ozone generator, the ozone may be drawn through a venturi injector/mixer in order to mix the ozone with the water. In this instance, it is well known that bubble size of the ozone is critical in transferring a requisite amount of ozone into the water to effect purification thereof. If the ozone bubble size is too large, the ozone will not have an opportunity to dissolve in the water, and will be lost. Conversely, the smaller the ozone bubble size the better mass transfer of ozone will occur into the water.

One problem with the venturi injector/mixers on the market today is that while they work satisfactorily to develop a small bubble size within a relatively narrow pressure differential range, when the pressure differential is increased above this range the bubble size also increases, resulting in decreased mass transfer of the ozone. As such, in systems where the pressure differential varies widely, such as in cooling towers and water cooled systems utilizing gravity fed outdoor tanks wherein a water level in the tanks varies within a wide range, transfer of ozone into the water will also vary widely. This is particularly a problem in view the recent discovery that bacteria that cause Legionnaires disease tend to colonize in larger organisms, such as amoebas, which are more resistant to lower levels of ozone, but which are killed by consistently higher levels of ozone, particularly in combination with chemical sanitizers. Additionally, consistent levels of ozone are known to kill cryptosporidium, a particularly resistant organism that may be fatal to those with weakened or otherwise compromised immune systems.

In other situations, such as swimming pools and spas, variations in design of the different manufacturers of swimming pools and spas and the different accessories associated with each individual pool or spa lead to situations where a particular venturi injector/mixer that works well on one pool may not work well on an identical pool fitted with an additional or different accessories, such as a water heater. In this instance, a different venturi must be custom fitted or the original venturi modified in accordance with the different available pressures and flow rates. Further, the pressure differential across the filter and other accessories in some pools is not high enough to power a venturi injector/mixer, leading to the requirement of a valve in the line after the pump, with the venturi inlet installed upstream from the valve and downstream from the pump. This valve is partially closed to develop the required pressure across the venturi injector/mixer, which in turn has a deleterious effect on seals in the pump and generally shortens life of the pump. Where the valve is located after the filter, then the filter may also be adversely affected by these higher pressures.

Accordingly, it is one object of the invention to provide a venturi injector/mixer having a variable injection/suction opening that is smaller with a lower inlet pressure and which increases in size with increasing pressure. Other objects will become apparent upon a reading of the following specification.

SUMMARY OF THE INVENTION

A venturi injector/mixer having an inlet portion and an outlet portion is provided. These portions are constructed to be longitudinally movable with respect to one another, forming an annular gap through which an additive substance may be provided via venturi suction. This annular gap is increased or decreased in accordance with pressure of the motive flow at the inlet. Increasing size of the gap allows more additive to be introduced into the motive flow up to the limit of longitudinal movement, after which mass transfer of the additive becomes relatively constant.

DETAILED DESCRIPTION OF THE DRAWINGS

Figure 1:
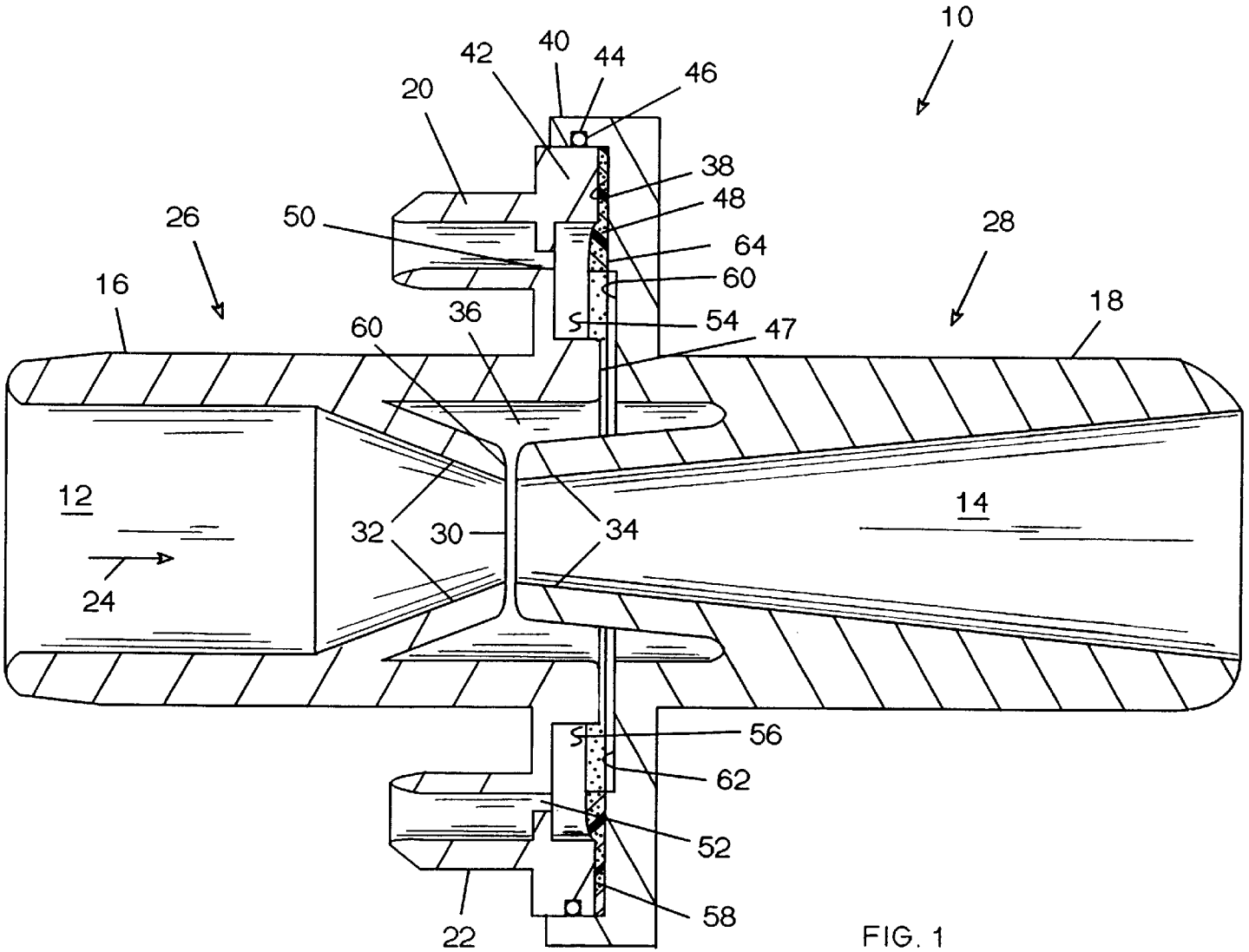
FIG. 1 is a cross sectional view taken through the center of one embodiment of a venturi injector/mixer of the present invention.

Referring to FIG. 1, and by way of example, one embodiment of a venturi injector/mixer 10 as contemplated by the present invention is shown. In this cross-sectional view, it is seen that injector/mixer 10 is conventionally provided with an inlet region 12 and an outlet region 14 in linear relation. Exterior sides 16 and 18, respectively, of inlet region 12 and outlet region 14 may be provided with threads or configured in a barbed shape to facilitate connection to flexible hoses. A pair of suction inlets 20, 22 are provided, making injector/mixer 10 capable of injecting a gas and liquid simultaneously into a motive flow passing as shown by arrow 24 between inlet region 12 and outlet region 14.

Figure 9:
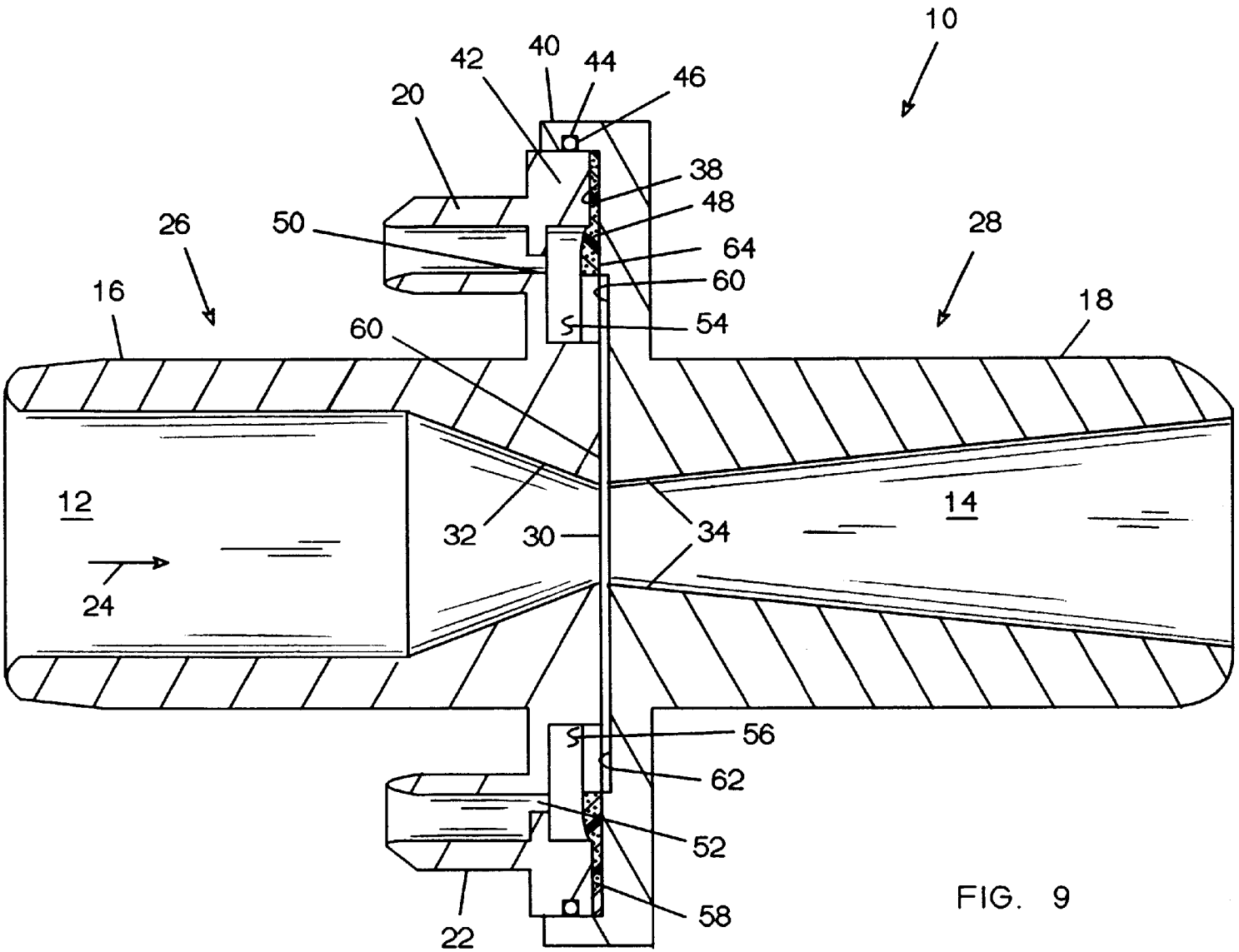
FIG. 9 is a cut away view showing particulars of construction of a self-adjusting venturi of the present invention.

Injector/mixer 10 is constructed of two discrete, separate components, an inlet body 26 and an outlet body 28, these parts fitted together at an interface 30 forming an annular gap as will be described. Just upstream interface 30, inlet body 26 is provided with a truncated cone-shaped converging region 32, with outlet body 28 provided with a truncated cone-shaped diverging region 34 just downstream interface 30. When bodies 26 and 28 are fitted together, an annular cavity 36 is formed around cone-shaped regions 32 and 34. In another embodiment, converging region 32 and diverging region 34 may terminate at an interface configured as a flange, with a groove or other passage leading from each of suction inlets 20 to an interface 30 between regions 32 and 34. In this embodiment, the annular cavity 36 as shown in FIG. 1 may be omitted, as generally shown in FIG. 9, with slots in the gasket and mating faces of bodies 26 and 28 providing a passageway to convey additives from the suction ports to interface 30.

A recess 38 is provided in outlet body 28, this recess having a lip 40 extending around an exterior of body 28. Inlet body 26 is provided with a mating region 42 closely fitted within recess 38 and against an interior wall of lip 40 so that body 26 is free to move longitudinally within recess 38. In one embodiment, an O-ring seal 44 may be provided to seal between inlet body 26 and outlet body 28, the O-ring shown in this example being positioned in a recess 46 formed in the interior wall of lip 40. In another embodiment, a gasket 48 may be positioned as shown between inlet body 26 and outlet body 28, which gasket 48 constructed of an elastic closed cell foam having a memory characteristic that causes the gasket to recover its thickness after compression, as will be further explained. Alternately, both gasket 48 and O-ring 44 may be utilized.

Suction inlets 20, 22 in inlet body 26 communicate via passages 50, 52 with recesses 54, 56 cut in an inner face 58 of inlet body 26. If desired, a check valve may be incorporated in recesses 54, 56 in order to prevent fluid from the motive flow from flowing into suction inlets 20, 22. Such a check valve may be in the form of a flap, or may be a free floating caged valve such as a ball or diaphragm. Grooves 60, 62 may be cut in an inner face 64 of recess 38 to allow communication between recesses 54, 56 and annular cavity 36 surrounding converging region 32 and diverging region 34. Interface 30 between converging region 32 and diverging region 34 forms an annular, contiguous injection port through which gasses, liquids or both may be drawn by venturi action into a motive fluid passing through injector/mixer 10. In the position shown in FIG. 1, a smallest gap, which may be about 0.03 inches or so, is present between regions 32 and 34, this being the gap dimension when little or no motive fluid is flowing through injector/mixer 10.

Figure 2:
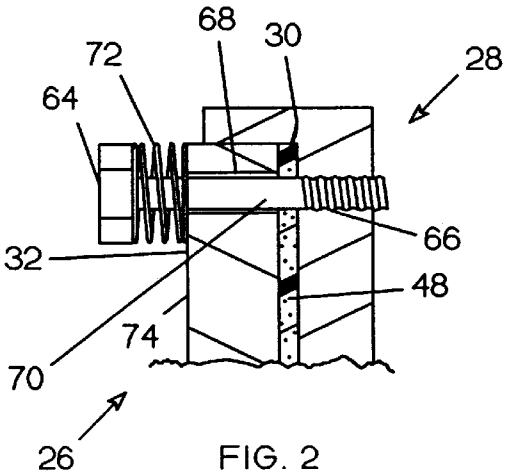
FIG. 2 is a view showing construction details of a venturi injector/mixer of the present invention.

As shown in FIG. 2, inlet body 26 and outlet body 28 may be held together by a plurality of bolts or other similar fasteners 64 threaded into a threaded opening 66 in outlet body 28. A bore 68 in inlet body 24 slidably accommodates a shaft portion 70 of bolt 64, with a compression spring 72 positioned between a head of bolt 64 and an outer surface 74 of body 26. In the disclosed embodiment, when bolt 64 is tightened so that foam gasket 48 is compressed to about one third to one half its fully compressed thickness, a gap of about 0.3 inches is present at interface 30. With this construction, it is seen that inlet body 26 and outlet body 28 may move apart relative to each other against the bias of springs 72, opening the gap at interface 30 (FIG. 1) while gasket 48 expands to maintains a sealed state of the gap between bodies 26 and 28.

During operation, and as stated, mixer/injector 10 is connected at its inlet region 12 to a source of fluid pressure, such as a pump outlet or outlet from a tank or the like, which pressure may vary within a relatively wide range. Outlet region 14 is coupled to whatever receives the flow from the pump or tank, and is at a lower fluid pressure, typically 1 PSI or so, due to the pressure drop across the venturi. In accordance with venturi principles, when a motive fluid flows through injector/mixer 10, a gas or additive supplied to annular chamber 36 via suction ports 20, 22 is drawn through the gap at interface 30 from chamber 36 and mixed with the motive fluid. Turbulence in the motive fluid flow is developed by diverging region 34, effectively causing mass transfer of the gas/additive into the motive fluid. This turbulence also exerts friction against inner walls of diverging region 34, this friction being translated as a longitudinal pull against the bias of springs 72 (FIG. 2). As pressure of the motive fluid at inlet region 12 increases, the longitudinal pull increases to a point where the bias of springs 72 is overcome, and inlet body 26 and outlet body 28 separate slightly, widening the gap at interface 30. In turn, this widening allows more gas/additive to be transferred into the motive fluid. As such, a higher inlet pressure reflective of increased flow results in more gas/additive being transferred into the motive flow. Also, as the gap widens, foam gasket 48 expands to seal the increasing gap between inlet body 26 and outlet body 28. As inlet body 26 and outlet body 28 are moved apart to the limit of their outward movement, which in the example shown may be set to about 0.1 inch or so, as by means of a stop (not shown), any further increase of pressure at the inlet does not effect an increase of gas/additive drawn through the suction ports, thus limiting the volume of material, and also bubble size, of gasses drawn into the injector/mixer when inlet pressures become excessively high. Further, since the annular gap at interface 30 is contiguous, and gases/liquids are supplied from a chamber surrounding interface 30 instead of directly from a suction line, flow at the gap is maintained at a more even, steady rate, a feature not found in any of the prior art known by Applicant. Further, two dissimilar additives are effectively mixed in cavity 36 prior to being transferred into the motive flow, another feature not found in the prior art. Advantageously, when halogen compounds and ozone are premixed in chamber 36, the resulting reactions enhance the effects of the halogen compound and ozone beyond what would occur if they were injected separately.

Figure 3:
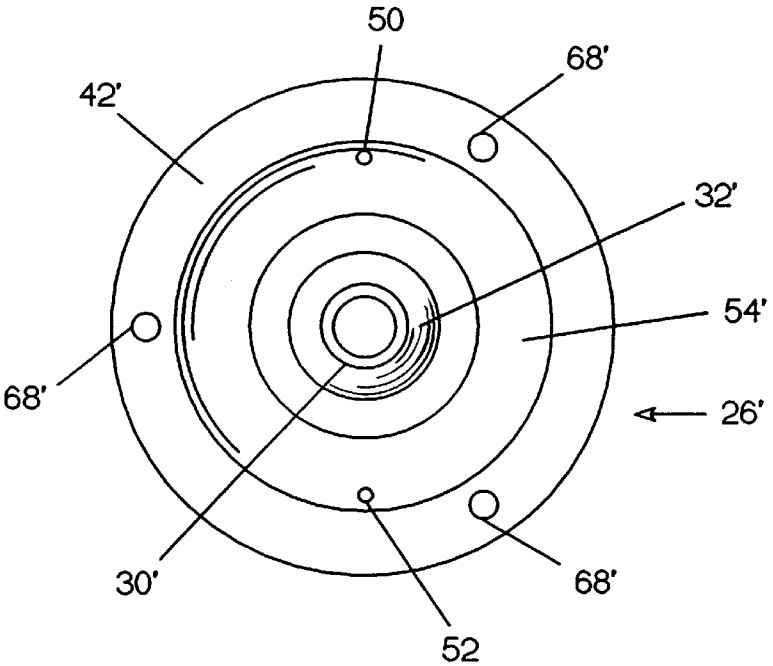
FIG. 3 is a plan view of one part of a different embodiment of a venturi injector/mixer of the present invention.
Figure 4:
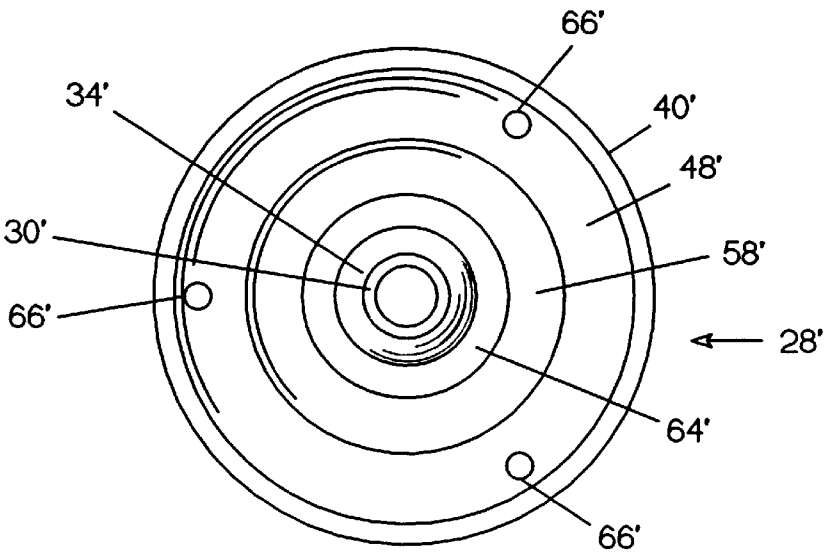
FIG. 4 is a plan view of another part of the different embodiment shown in FIG. 3.

In a similar embodiment, and as shown in FIGS. 3 and 4, recesses 54, 56 in inlet body 26 of FIG. 1 may be configured in an inlet body 26' (FIG. 3) as a single annular recess 54'. Here, openings 50, 52 communicate with suction ports 20, 22 (FIG. 1) and annular recess 54' (FIG. 3), with annular recess 54' being at least in partial registry with an annular recess 58' in outlet body 28' (FIG. 4). Annular recess 58' in turn communicates with an annular cavity analogous to annular cavity 36 (FIG. 1) formed by converging region 32' of body 26 and diverging portion 34' of body 28, which cavity supplying gas/additive to gap 30'.

Operation of the embodiment of FIGS. 3 and 4 is similar to that of the embodiment shown in FIG. 1, except that a greater volume of gas and additive may flow through the communicating annular regions 54', 58' to interface 30' than through grooves 60, 62 in outlet body 28. Additionally, recesses 54', 58' may be constructed to be shallow, limiting the amount of gas/additive pulled into the injector/mixer when the inlet pressure is low. As the inlet pressure increases and the inlet body and outlet body move apart as described, recesses 54', 58' become wider, allowing more gas/additive to be transferred into the motive flow.

Figure 6:
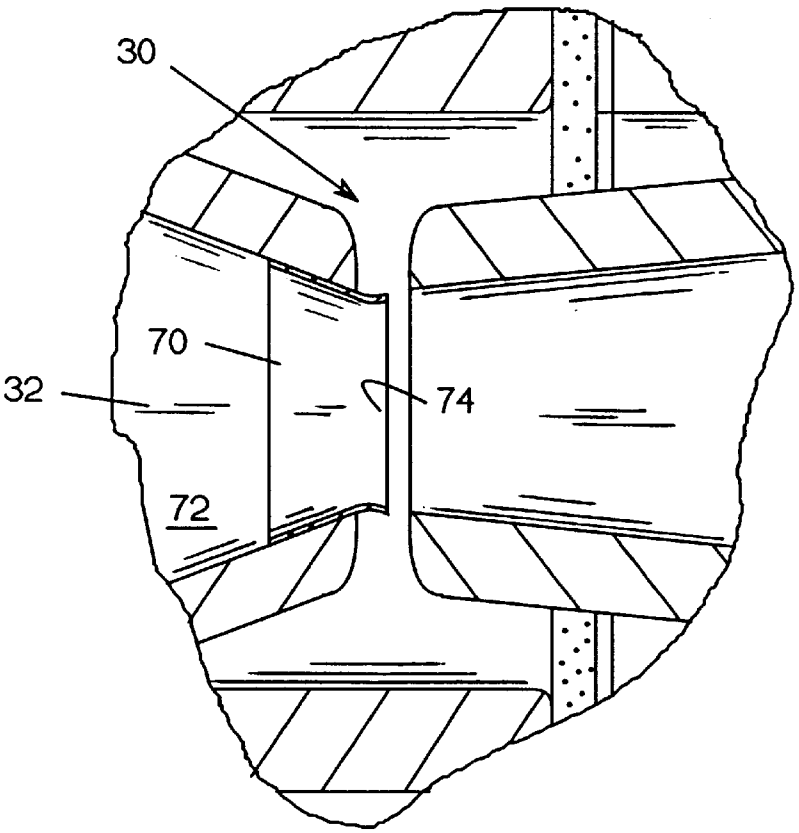
FIGS. 5 and 6 are illustrations of another embodiment of a self-adjusting venturi injector/mixer, with FIG. 5 showing a condition of this venturi during low flow of motive fluid and FIG. 6 showing a condition of the venturi during high flow of motive fluid.
Figure 5:
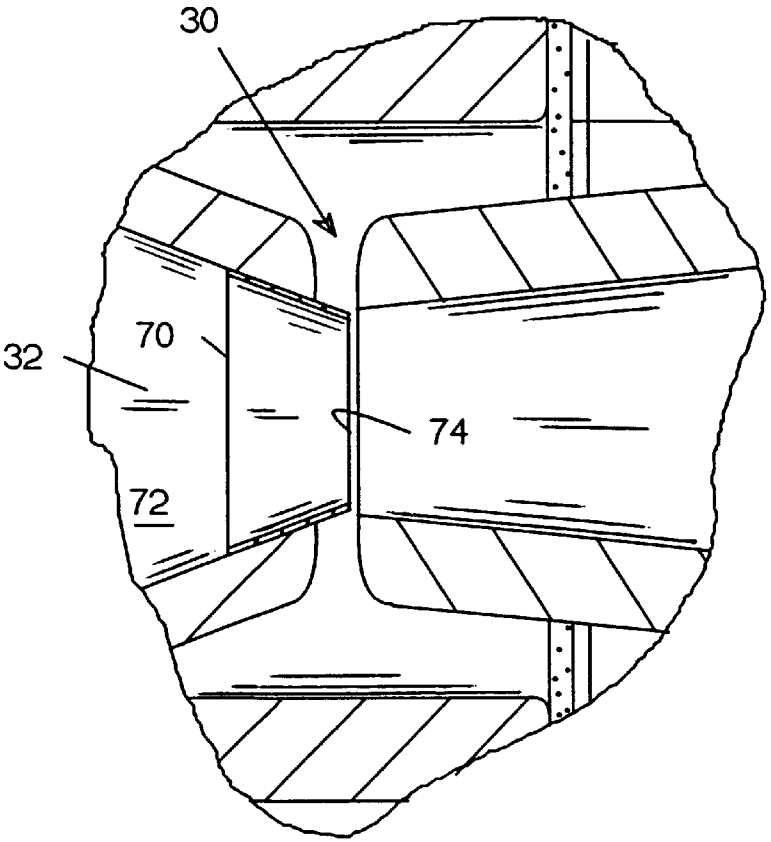

FIGS. 5 and 6 show an embodiment of the invention wherein a truncated conical member 70 is bonded or otherwise fixed or placed to/into an inner surface 72 of converging region 32. Here, a primary feature or characteristic of member 70 is that end 74 thereof extends slightly into the motive flow, and is constructed of a relatively elastic material so that it deforms somewhat under pressure of a high motive flow, as shown in FIG. 6. During periods of low motive flow (FIG. 5), end 74 is not deformed, and maintains its original conical configuration, with various intermediate flows deforming end 74 in a generally proportional relationship. So deformed, member 70 limits an amount of additive transferred during periods of higher motive flow, and also maintains a small bubble size. As should be evident from the drawings, during periods of higher flow, deformation of end 74 partially closes gap 30. As such, an amount of transferred additive increases directly with flow up to a point where end 74 of member 70 begins to deform, after which the additive is throttled to limit the rate of mass transfer into the motive flow while maintaining a small bubble size of a gaseous additive.

Figure 7:
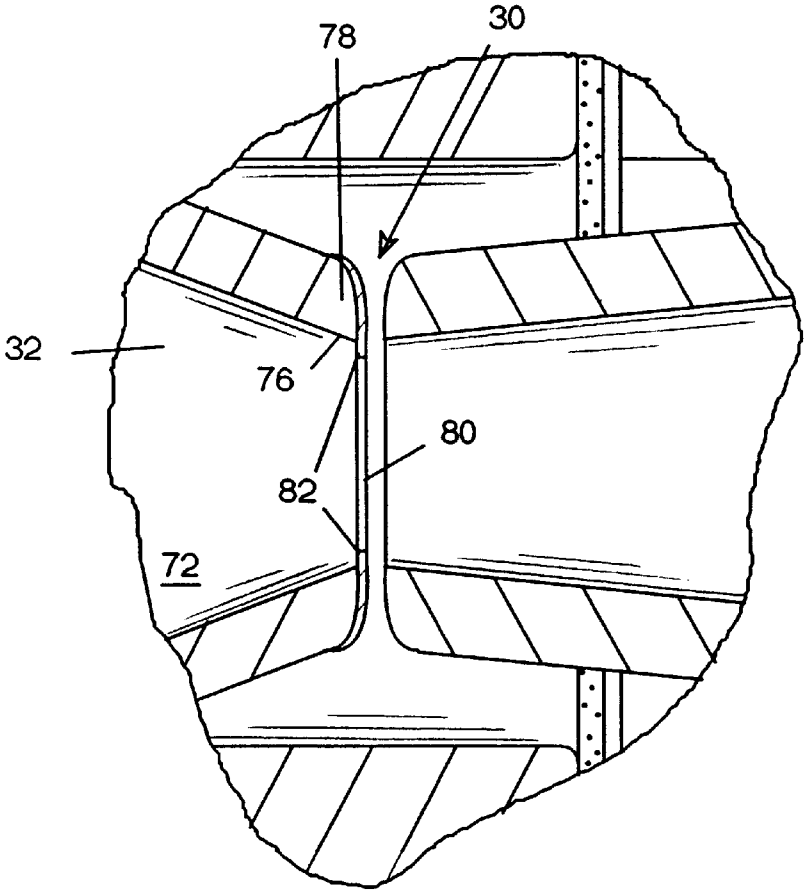
FIGS. 7 and 8 is yet another embodiment of a self-adjusting venturi injector/mixer, with FIG. 7 showing condition of the venturi during low flow of motive fluid and FIG. 8 showing condition of this venturi during high flow of motive fluid.
Figure 8:
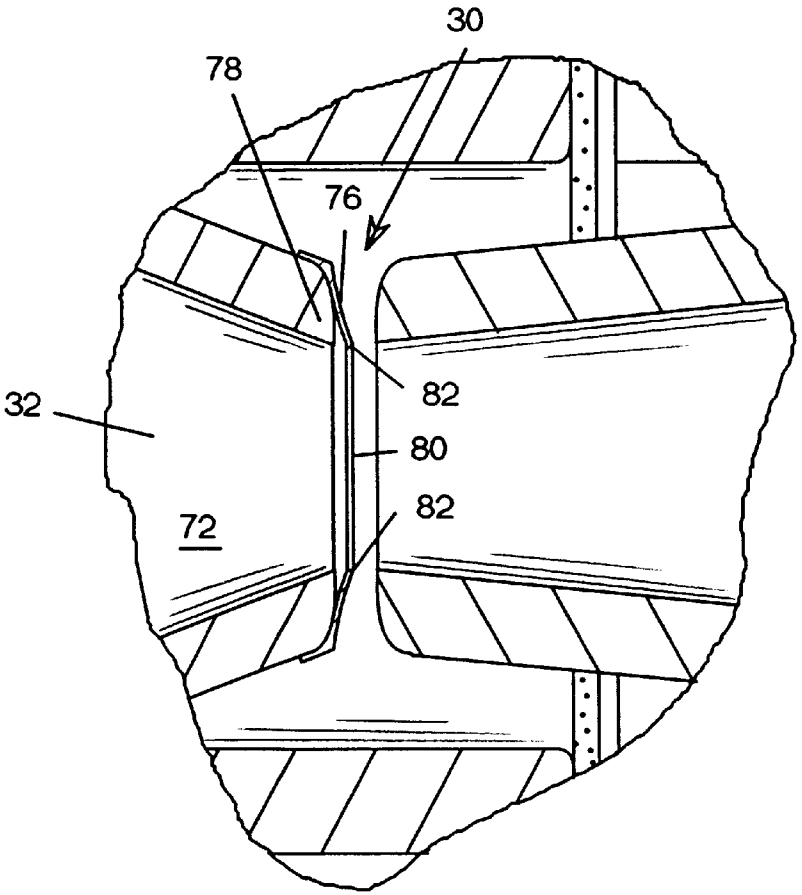

FIGS. 7 and 8 illustrate a similar embodiment to that shown in FIGS. 5 and 6, with a member 76 configured as a diaphragm-like structure that fits over and may be bonded to or otherwise attached to an end region 78 of converging region 32. An opening 80 is provided in member 76, opening 80 being sized slightly smaller than the opening in converging region 32 so that edges of opening 80 extend slightly into the motive flow. As with member 70 in FIGS. 5 and 6, at least an area 82 around opening 80 is constructed of a flexible material that will deform under a high motive flow. Thus, as shown in FIG. 8, during a high motive flow gap 30 is partially blocked by deformed edges 82 of member 80. During periods of lower motive flows (FIG. 7) edges are undeformed or deformed to a lessor extent, allowing a higher proportion of additives to be transferred into the motive flow.

The venturi injector/mixers as shown in FIGS. 5 and 6 are advantageous in recirculating systems such as swimming pools, spas water cooling systems for buildings, etc. where liquids such as liquid chlorine, algaecides or preservatives are mixed with the recirculating water. In this instance, where a swimming pool or spa is using a multispeed pump, adjustment of a chlorine or algaecide ratio is not necessary when switching between a lower and higher pump speed. Likewise, where it is desired to maintain algaecide and/or sanitizer levels in a cooling tower supplied with water from a gravity fed tank or other recirculating system, a quantity of additive will automatically increase with increasing motive flow up to the point where edges of the diaphragm or conical member begin to deform, after which transfer of additive will begin to be throttled and maintained generally at that flow level with a consistently small bubble size. Thus, where water to be sanitized is fed by gravity from a tank and a level of water in the tank fluctuates, the amount of sanitizer transferred into the water is automatically adjusted within the dynamic range of the self-adjusting venturis shown in FIGS. 5–8. Of course, the dynamic range of these venturis may also be adjusted by replacing a particular member 70, 76 with a different member 70, 76 having a different coefficient of flexibility or expansion of the throttling edges. In addition, the conical member or diaphragm with flexible, deformable edges as described above may be incorporated in the venturi/mixer as shown in FIG. 9.

In any of the embodiments described herein, the inlet body and outlet body are pulled apart by turbulence against the inner walls of the diverging region. In the instance where it is felt that sufficient frictional pull is not being exerted against walls of the diverging region, such walls may be provided with a roughened surface in order to more effectively utilize momentum of the fluid passing through the injector/mixer. Additional features may also be provided along walls of the diverging region, such as concentric or semi-concentric grooves formed therein in order to increase longitudinal pull between the inlet and outlet bodies forming the injector/mixer.

Having thus described my invention and the manner of its use, it should be apparent to one skilled in the art that incidental modifications may be made thereto that fairly fall within the scope of the following appended claims, wherein I claim:

1. A method for injecting and mixing a quantity of additive substance into a motive flow comprising the steps of:

1) converging said flow to develop a higher velocity, lower pressure converging flow, 2) providing an opening through which said converging flow is directed, 3) supplying an additive substance to said opening so that said additive substance is drawn into said converging flow, 4) diverging said converging flow to develop a higher pressure, lower velocity diverging flow, effectively mixing said additive substance in said diverging flow, 5) varying size of said opening responsive to a pressure of said converging flow, thereby controlling amount of said additive substance provided to said converging flow and also maintaining a small bubble size where said additive substance is in gaseous form.

2. A method as set forth in claim 1 further comprising the step of implementing said opening as an annular gap.

3. A method as set forth in claim 2 wherein the step of varying said opening further comprises the step of widening and narrowing a width dimension of said annular gap.

4. A method as set forth in claim 2 further comprising the step of providing an elastically deformable edge around said annular gap, whereby with increasing said pressure said edge is increasingly deformed to partially close said annular gap and with decreasing pressure said edge increasingly reverts to its original shape to at least partially open said annular gap.

5. A mixing device comprising:

an inlet region having a converging region disposed for effecting conversion of a fluid flow therethrough from a higher pressure to a higher velocity flow at a lowered pressure, an outlet region having a diverging region disposed to receive said higher velocity fluid flow and convert said higher velocity fluid flow to a lower velocity fluid flow at a higher pressure, an interface opening between said converging region and said diverging region, said interface opening being variable in size responsive to pressure of said fluid flow at said inlet region, at least one suction port communicating with said interface, for providing an additive substance to said interface, whereby as said pressure of said fluid flow at said inlet increases, size of said interface opening increases, and as said pressure of said fluid flow at said inlet region decreases size of said interface opening decreases, thereby varying a quantity of said additive substance directly with pressure of said fluid flow at said inlet region.

6. A mixing device as set forth in claim 5 further comprising an annular cavity surrounding said interface opening, said cavity communicating with said suction port.

7. A mixing device as set forth in claim 5 further comprising a plurality of suction ports.

8. A mixing device as set forth in claim 5 wherein said inlet region and said outlet region are longitudinally slidably disposed with respect to each other, with a region other than said interface region between said inlet region and said outlet region sealed with a material that is expandable and compressible so as to accommodate relative movement between said inlet region and said outlet region.

9. A mixing device as set forth in claim 8 wherein said inlet region is provided with a spring bias toward said outlet region, with said fluid flow through said outlet region exerting a pull on said outlet region against said spring bias that draws said outlet region away from said inlet region, thereby increasing a size of said interface opening.

10. A mixing device as set forth in claim 5 wherein said interface opening comprises an annular gap between said inlet region and said outlet region, said annular gap surrounding said fluid flow.

11. A mixing device as set forth in claim 10 further comprising a conical member having an elastic, deformable, truncated end, said truncated end positioned in said annular gap so that said fluid flow impinges on a peripherial region of said truncated end, whereby as pressure of said fluid flow increases, said truncated end is deformed to partially close said annular gap.

12. A mixing device as set forth in claim 10 further comprising a diaphragm having a circular opening therein sized slightly smaller than said annular gap, and positioned so that said opening is concentric with said annular gap, said diaphragm having an elastic, deformable edge around said opening so that a higher said fluid pressure deforms said edge to partially close said annular gap.

13. A mixing device for injecting an additive substance into a motive flow of fluid, said mixing device comprising:

an inlet portion having a converging region for converting said motive flow to a lower pressure, higher velocity flow, an outlet portion having a diverging region for receiving said lower pressure, higher velocity flow, said diverging region serving to convert said lower pressure, higher velocity flow to a higher pressure, slower velocity flow, an annular injection gap between said converging region and said diverging region, means for allowing longitudinal movement of said inlet portion relative to said outlet portion responsive to changes of pressure of said motive flow, thereby altering width of said annular injection gap, accommodating sealing means for sealing between said inlet portion and said outlet portion so that said inlet portion and said outlet portion are sealed against leakage at any position of said longitudinal movement, at least two injection ports in communicating relation with said annular gap, for providing a capability of adding at least said additive substance through a one of said injection ports and a second, dissimilar additive substance through a second of said injection ports, whereby said inlet portion moves relative to said outlet portion responsive to a change of pressure of said motive flow, altering said annular injection gap to adjust flow of said additive substances to compensate for said change of pressure of said motive flow.

14. A mixing device as set forth in claim 13 wherein said means for allowing longitudinal movement further comprises:

spring biasing means for biasing said inlet portion toward said outlet portion, a compressible, flexible gasket between said inlet portion and said outlet portion, and of a thickness so that said annular injection gap is at its minimum when said gasket is compressed to approximately ½ its original thickness by said spring biasing means, said gasket further characterized by a memory that causes said gasket to expand when said inlet portion and said outlet portion are moved apart.

15. A mixing device as set forth in claim 13 further comprising a truncated cone-shaped member in said converging region, with an open, narrower end being slightly smaller than a smallest opening in said converging region, with edges of said narrower end being elastically deformable, whereby greater rates of said motive flow deforms said narrower end to partially close said annular injection gap, maintaining a small bubble size when said additive substance is in a gaseous form, said narrower end reverting to its original undeformed shape with lesser rates of said motive flow.

16. A mixing device as set forth in claim 13 further comprising a diaphragm in said annular gap, said diaphragm having an opening therein slightly smaller than a smallest opening in said converging region, with an edge of said diaphragm being elastically deformable whereby greater rates of said motive flow deform said edge to partially close said annular gap, maintaining a small bubble size when said additive material is in a gaseous form, said edge reverting to its original shape when said motive flow is at lessor rates.

* * * * *